US008181556B2

(12) United States Patent
Brandenburg et al.

(10) Patent No.: US 8,181,556 B2
(45) Date of Patent: May 22, 2012

(54) METHOD AND APPARATUS FOR CONTROLLING THE CUT REGISTER OF A WEB-FED ROTARY PRESS

(75) Inventors: Günther Brandenburg, Gröbenzell (DE); Stefan Geissenberger, Ausburg (DE); Andreas Klemm, Bad Wörishofen (DE)

(73) Assignee: MAN Roland Druckmaschinen AG, Offenbach am Main (DE)

( * ) Notice: Subject to any disclaimer, the term of this patent is extended or adjusted under 35 U.S.C. 154(b) by 11 days.

(21) Appl. No.: 12/001,128

(22) Filed: Dec. 10, 2007

(65) Prior Publication Data

US 2008/0148981 A1 Jun. 26, 2008

Related U.S. Application Data

(63) Continuation of application No. 10/913,247, filed on Aug. 6, 2004, now abandoned.

(30) Foreign Application Priority Data

Aug. 6, 2003 (DE) ..... 103 35 888

(51) Int. Cl.
*B26D 5/28* (2006.01)

(52) U.S. Cl. ..... 83/15; 83/13; 83/76

(58) Field of Classification Search ..... 83/13, 15, 83/72, 76, 286, 287, 350–357
See application file for complete search history.

(56) References Cited

U.S. PATENT DOCUMENTS

| | | | | |
|---|---|---|---|---|
| 1,331,727 | A * | 2/1920 | Seymour | 83/110 |
| 3,052,242 | A * | 9/1962 | Levadi | 131/84.4 |
| 3,053,242 | A | 9/1962 | Levadi | |
| 3,280,737 | A * | 10/1966 | Huck | 101/181 |
| 4,464,959 | A * | 8/1984 | Larson | 83/37 |
| 4,524,812 | A * | 6/1985 | Murphy | 144/135.2 |
| 4,793,564 | A * | 12/1988 | Hank et al. | 242/417.2 |
| 4,868,472 | A * | 9/1989 | Daggett | 318/568.2 |
| 5,122,964 | A * | 6/1992 | Hayashi et al. | 700/167 |
| 5,377,428 | A * | 1/1995 | Clark | 34/446 |
| 5,377,964 | A * | 1/1995 | Haller | 270/21.1 |
| 5,452,632 | A * | 9/1995 | Durr et al. | 83/13 |

(Continued)

FOREIGN PATENT DOCUMENTS

DE G85 01 065 6/1985

(Continued)

OTHER PUBLICATIONS

Control Techniques Drives and Controls Handbook by: Drury, Bill © 2001 Institution of Engineering and Technology. Chapters 3 and 7.*

(Continued)

*Primary Examiner* — Sean Michalski
(74) *Attorney, Agent, or Firm* — Cozen O'Connor

(57) ABSTRACT

To control the cutting register of a web in a web-fed rotary press with little expenditure, a specific item of image information or a measuring mark of a printed web is registered by at least one sensor. The sensor generates a registration signal which is supplied to a control device. The registration of the image information or measuring marks is carried out immediately before or on a knife cylinder. A cutting register error is determined from the registration information and the position of the knife cylinder is influenced to correct the determined cutting register error.

22 Claims, 4 Drawing Sheets

U.S. PATENT DOCUMENTS

| | | | | |
|---|---|---|---|---|
| 5,813,587 | A * | 9/1998 | Nordgren | 226/29 |
| 5,857,392 | A * | 1/1999 | Parkander | 83/72 |
| 6,314,333 | B1 * | 11/2001 | Rajala et al. | 700/122 |
| 6,405,098 | B1 * | 6/2002 | Mehlis et al. | 700/139 |
| 6,501,998 | B1 * | 12/2002 | Pfeiffer | 700/37 |
| 6,997,075 | B2 * | 2/2006 | Serebrennikov et al. | 74/339 |
| 7,444,191 | B2 * | 10/2008 | Caldwell et al. | 700/29 |
| 7,496,426 | B2 * | 2/2009 | Theilacker | 700/125 |
| 2001/0022143 | A1 | 9/2001 | Stern | |
| 2006/0102027 | A1 * | 5/2006 | Theilacker | 101/226 |
| 2006/0185551 | A1 * | 8/2006 | Mehlis et al. | 101/484 |
| 2009/0039130 | A1 * | 2/2009 | Schultze et al. | 226/1 |

FOREIGN PATENT DOCUMENTS

| | | |
|---|---|---|
| DE | 42 02 363 A1 | 8/1993 |
| DE | 42 34 308 C2 | 4/1994 |
| EP | 0 950 519 | 10/1999 |
| GB | 2 272 402 | 5/1984 |
| GB | 2 271 318 | 4/1994 |

OTHER PUBLICATIONS

"MFA". VanDoren, Vance J. "Techniques for Adaptive Control". Elsevier © 2003. CHapter 4.*

"Control System Fundamentals". pp. 2.59 and 2.60, McMillian, G.K.; Considine, D.M. (1999). Process/Industrial Instruments and Controls Handbook (5th Edition). McGraw-Hill. Online version available at: HttP://www.knovel.com/knovel2/Toc.jsp?bookid+658 &vertical1D=0.

"Cascade Control". Available at http://www.20sim.com/wevhelp4/demo/Control/PID-control/Cascade_Control.htm. Viewed May 24, 2007.

* cited by examiner

METHOD AND APPARATUS FOR CONTROLLING THE CUT REGISTER OF A WEB-FED ROTARY PRESS

CROSS REFERENCE TO RELATED APPLICATION

This application is a continuation of U.S. patent application Ser. No. 10/913,247 which was filed with the U.S. Patent and Trademark Office on Aug. 6, 2004 now abandoned. Priority is claim on patent application No. 103 35 888.9 filed in Germany on Aug. 6, 2003.

BACKGROUND OF THE INVENTION

1. Field of the Invention

The invention relates to a method and apparatus for controlling the cutting register on a web running through a web-fed rotary press.

2. Description of the Related Art

In web-fed rotary presses, it is known to use an actuating roll which can be moved in linear guides as an actuating element for correcting errors in the position of the cutting register on a web. In this case, the actuating roll changes the paper path length between two draw units to correct the cutting register error. Register rolls of this type are shown, for example, in DE 85 01 065 U1. The adjustment is generally carried out by an electric stepping motor. Apparatuses of this type are afflicted with a relatively high mechanical and electrical complexity.

SUMMARY OF THE INVENTION

It is an object of the invention to provide a simple method of controlling the cutting register error in a web-fed rotary press.

In the specification and claims, the term 'clamping point' refers to a nip through which the web runs in the rotary printing press such as, for example, in a printing unit, cooling unit, turner unit or knife cylinder unit. The 'cutting register error' is the deviation of the cutting register from its intended position, the 'total cutting register error' is the deviation of the cutting register, at the time of cutting by the knife cylinder, from its intended position, and the 'partial cutting register error' is the deviation of the cutting register from its intended position at a clamping point prior to or upstream of the knife cylinder.

The object is achieved by registering a cutting register on a web running through a rotary press by a sensor arranged upstream of or at a knife cylinder of the rotary press. The registration information is supplied to a control device which determines a cut register error. A relative position or speed of the knife cylinder or other clamping point in the rotary press is influenced in response to the determined cutting register error to correct the cutting register error.

In the method according to the invention, the running time of the web image points along a constant web path is adjusted whereas, in the prior art, a change is made in the web length at constant web speed.

It is important that the measurement of the cutting register error is carried out before the knife cylinder, the knife cylinder having a controlled-angle individual drive and register control being superimposed on its position and/or rotational speed control. Furthermore, the cutting register control may be achieved with the aid of a subordinated control loop, in which the partial cutting register error $Y_{13}^*$ at or before the turner unit, for example as early as at the end of the cooling unit, is measured and compensated for via the lead of the turner unit.

It is important that, to control the cutting register error, a specific or striking item of image information of the printed web is registered by at least one sensor and is supplied to a control device. It is not necessary for this image information to be a placed mark. An item of image information suitable for the deviation of the position of the printed image with respect to its intended position, based on the location and time of the cut, that is to say for the cutting register error $Y_{14}$, is measured immediately before or on a knife cylinder (clamping point 4) and, by at least one control loop, is controlled to its predefined set point, for example to the value zero, in the case of correction via the knife cylinder, a controller predefining an angle set point $\alpha_{14w}$ for an angle control of the knife cylinder. As an alternative, the correction may be made via at least one non-printing clamping point (clamping point 2 or 3) located before the knife cylinder, using a controller predefining the register set point $Y_{12w}^*$ or $Y_{13w}^*$ for a subordinated register controller, which corrects the part register error $Y_{12}^*$ or $Y_{13}^*$ via the speed or lead at the clamping point 2 or 3. As a further alternative, if at least two non-printing clamping points i and k and their speeds are used for the correction, associated control groups being coordinated in such a way that the cutting register error $Y_{14}$ is controlled to the predefined set point $Y_{14w}^*$, for example equal to zero. In the following text, for simplicity, mention will always be made of the value zero in the case of the set point $Y_{14w}^*$, it also being possible for another suitable value to occur in its place.

For the determination of the controlled variables, the use of sensors is the preferred embodiment. However, models may also partly or completely replace the sensors, that is to say the variables are estimated in an equivalent way with the aid of mathematical or empirical models.

It is significant that, when the limits of a control variable, e.g., the control variable $\omega_{3w}$, are exceeded, the control of the part register error $Y_{13}^*$ is transferred from the controller of the clamping point 3 to a controller 1.1 of the clamping point 1, that is to say the angle of the clamping point 1 is tracked and the excessively small or excessively large value of $\omega_{3w}$ is moved back into the permissible range. The tracking of the angle of the clamping point 1 is carried out for all operating states in which $\omega_{3w}$ lies within the limits by an adaptation element 1.2, a set point for the readjustment of the angle $\alpha_{1w}$ being calculated with the aid of a mathematical model, as a result of which a sufficient reserve of the manipulated variable, e.g., the control variable $\omega_{3w}$ or lead of the clamping point 3, is always ensured. In the mathematical model, the relationship between the lead change needed for the correction of the part register error $Y_{13}^*$ and the resultant correction value $\alpha_{1w}$ is calculated. The tracking of the angle of the clamping point 1 is advantageously carried out slowly as compared with the control of $Y_{13}^*$, as a result of which ghosting arising from excessively fast position changes of the printing units (clamping point 1) is avoided and decoupling of the control loops is achieved.

It is important in this case that tracking, in particular of the controlled-angle clamping point 2, is carried out with angular synchronism with respect to the clamping point 1 and, as a result, the web time constant between clamping point 1 and clamping point 2 becomes ineffective.

Tracking the lead of clamping point 2 can also replace tracking the angle at clamping point 1, provided that a change in the lead of the clamping point 2 does not entail self-compensation of the force $F_{23}$. This is the case if moisture and/or heat is input into the web in the preceding web sections. The cooling unit of a web-fed press, in particular of a web-fed rotary offset press, can therefore be used in particular as clamping point 2.

The solution according to the invention does not require any additional mechanical web guiding element. For the purpose of cutting register error correction, existing, non-printing draw units or clamping points may be used, such as in the cooling unit, pull rolls in the folder superstructure, the former roll or further draw units located in the web course between the last printing unit and knife cylinder, which are preferably driven by variable-speed individual drives.

Because of the special characteristics of the control system, the cutting register control with the aid of the lead of a clamping point is dynamically faster than in the case of the conventional solution by a register roll, since a change in the lead at the relevant clamping point replaces a path change. A significant advantage of this register control with the aid of the lead of a clamping point is that barely any wear of the mechanical transmission elements occurs, as would be the case in dynamically fast control with the aid of changing the path of an actuating roll. A further advantage is that the control engineering expenditure in the case of this cutting register error control with the aid of the lead of a clamping point is lower than in the case of a dynamically fast control with the aid of the path change of an actuating roll.

The parameters that enter into the cutting register error control system are largely independent of the properties of the rotary press. Furthermore, the cutting register accuracy can be increased substantially by the new method.

The tracking of the web tension may also be achieved with the aid of the dancer roll force, this being determined from the pressure of an associated pneumatic cylinder, the force being measured, supplied to a web tension controller and compared with the force set point, the output variable from the controller either being directly the manipulated variable for the pneumatic cylinder or the set point $F_{01w}$, if there is a subordinate control loop for the input web tension $F_{01}$. A web tension control loop for the web tension $F_{01}$ can also replace the dancer roll. This force adaptation always ensures that the force change which occurs quickly because of a disturbance being controlled out is dissipated relatively slowly as compared with this control.

The invention also relates to an apparatus for implementing the method for controlling the cutting register error, whose clamping points 1 to 4 can be driven independently of one another by drive motors with associated current, rotational speed and possibly angle control, and in which the cutting register and/or associated further register deviations $Y_{13}^*$, $Y_{1i}^*$, $Y_{ik}^*$ on or before a knife cylinder and/or at or before one or more clamping points i, k, 1 to 4 arranged before this knife cylinder (clamping point 4) can be registered by at least one sensor using a specific item of image information or measuring marks of the printed web and, in order to influence the cutting register error $Y_{14}$, can be supplied to a closed-loop and/or open-loop control device in order to change angular positions or circumferential speeds $v_1$ to $v_4$, $v_i$, $v_k$ of the respective clamping point Ki, Kk, K1 to K4.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

In the drawings, wherein like reference characters denote similar elements throughout the several views.

DETAILED DESCRIPTION OF THE PRESENTLY PREFERRED EMBODIMENTS

The function of the present invention will be explained using the exemplary embodiments on a four-roll system. It is pointed out that, in a real press, as many printing units as desired, that is to say, for example, four printing units, of a web-fed offset illustration press or newspaper press or another type of rotary press may replace a clamping point 1 of the illustrated four-roll system. The principle of register correction described in the following text by two control loops superimposed on each other, one being given as actual value the register error measured immediately before the knife cylinder, the other the error from a clamping point located further in front, can be transferred with the same effect to all rotary presses.

Functional Explanation of the Four-Roll System

Figure 1:
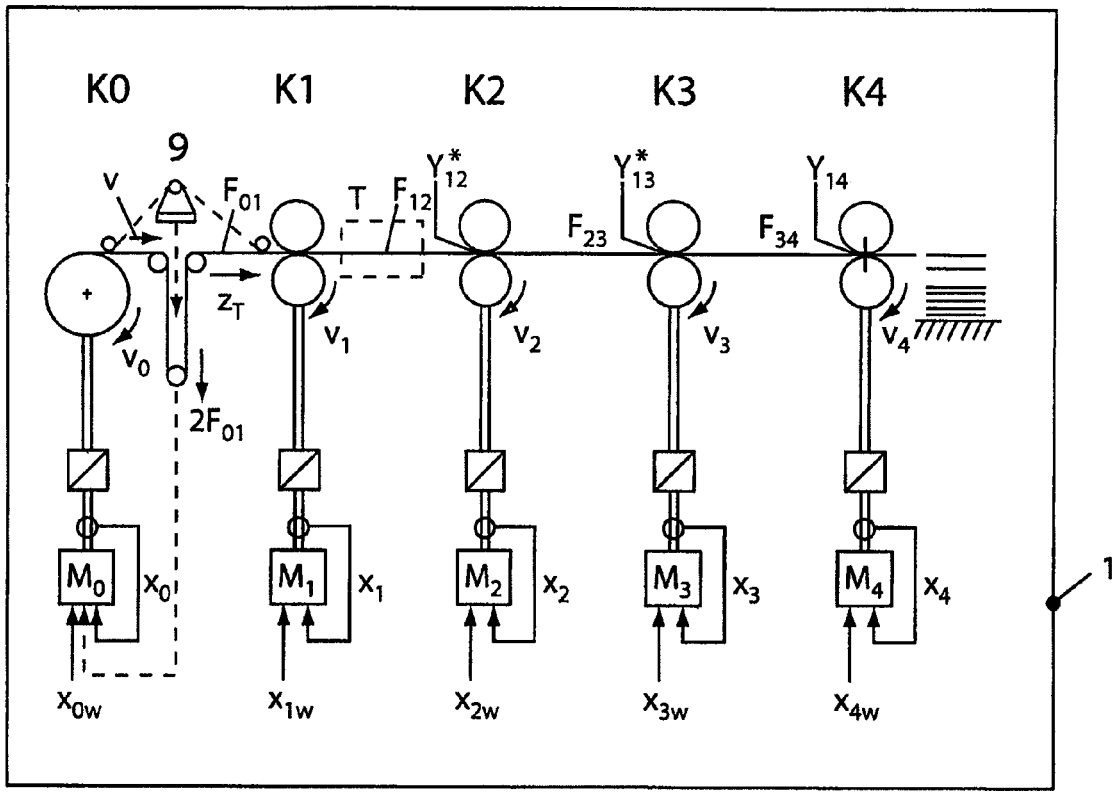
FIG. 1 is a clamping point diagram of a rotary press having controlled drives.

The four-roll system of FIG. 1 is a simplified form of a rotary press, in particular a web-fed offset press. In FIG. 1, clamping point 1 (K1) may, for example, represent all the printing units following the threading unit. In the exemplary embodiment, clamping point 2 (K2) may represent the cooling unit in the case of an illustration press, clamping point 3 (K3) may represent the turner unit and clamping point 4 (K4) may represent the folding unit with the knife cylinder that determines the cut. Variables $v_i$ are the circumferential speeds of rollers or cylinders forming the clamping points, which are to be approximated by the behavior of wrapped rolls with Coulomb friction. In the case of rotary presses, the term "lead" is used instead of the term "speed". The lead $W_{i,i-1}$ of a clamping point i (Ki) with respect to a clamping point i-1 (Ki-1) is given by the expression $$W_{i,i-1} = \frac{v_i - v_{i-1}}{v_{i-1}}$$

In the following text, the terms "speed" and "lead" will be used synonymously. The web tension in a section i-1, i will be designated $F_{i-1,i}$. The changes in the modulus of elasticity and in the cross section of the incoming web are combined in $z_T$. The cutting register error $Y_{14}$ at the knife cylinder is to be designated the total cutting register error or, in brief, the cutting register error. A register error $Y_{1i}^*$ which has occurred previously, measured at a non-printing clamping point i, will be called the partial cutting register error or, in brief, partial register error.

Figure 2:
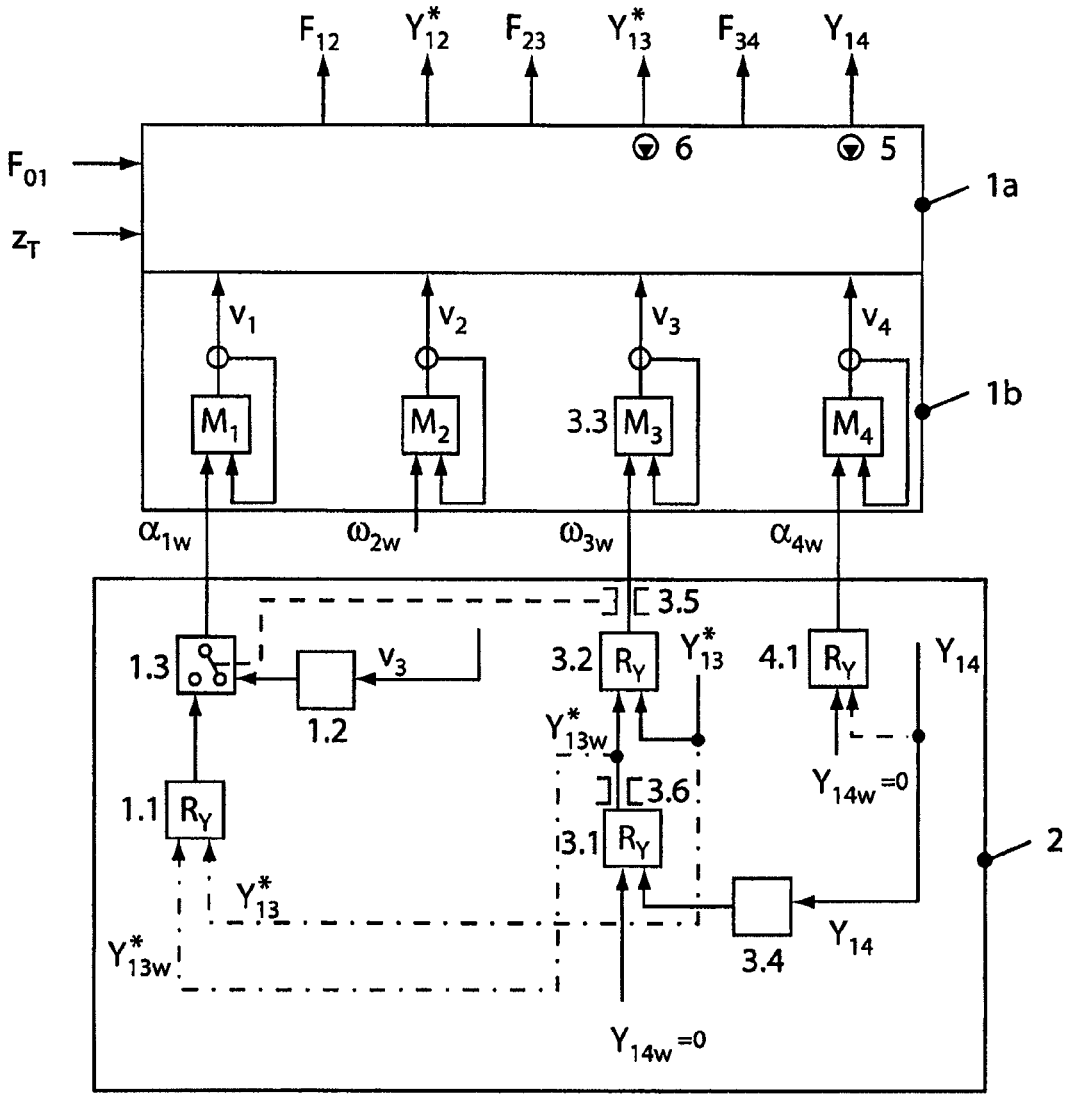
FIG. 2 is a schematic diagram of a control arrangement for controlling the cutting register with force limitation via the printing units.

The system 1 of FIG. 1 will be considered as a mechanical controlled system (block 1*a* in FIG. 2) with associated actuating elements (controlled drives in block 1*b* in FIG. 2). The two controlled variables are the partial cutting register error $Y_{13}^*$ and the total cutting register error $Y_{14}$. The partial register error $Y_{13}^*$ is the deviation, measured at the clamping point 3 (K3), of a position of a fixed image reference point printed at clamping point 1 (K1) from its intended position based on steady operation. The deviation is a time dependent value. Accordingly, the set point has discrete values in time. The cutting register error $Y_{14}$ is the deviation of a position of the cut line lying between two printed pictures from its intended position at the cutting time of the clamping point 4 (K4), relative to the clamping point 1 ($K_1$). A further controlled variable is the position, that is to say the angle, of the clamping point 1 ($K_1$). The actuating elements are formed by the controlled drive motors M1 to M4. The input variables $X_{iw}$ illustrated in FIG. 1 stand for the angular velocity (rotational speed) set points or angle set points of the controlled drives M1 to M4, as can be seen in more detail in FIG. 2.

The unsteady or steady mass flow of the web supplied to the system via the input of the clamping point 1 ($K_1$), measured in $kgs^{-1}$, is determined by the circumferential speed $v_1$ of the clamping point 1 ($K_1$) and the extension $\epsilon_{01}$. In the case of Hookean material, the force $F_{01}$ is proportional to the extension $\epsilon_{01}$. The force $F_{01}$ is set by the pressing force of a dancer roll or self-aligning roll on the web passing through or by a tension control loop which—in accordance with the position set point or force set point—directly or indirectly via a further device for adjustment of the web tension—controls the circumferential speed of a clamping point 0 (e.g., an unwind device). Only the circumferential speed of the unwind device is capable of changing the steady mass flow introduced into the system in a steady manner. In the following text, it will be assumed that changes in $F_{01}$ or in $v_1$ effected as a result of the change in the circumferential speed of the unwind device change the unsteady or steady mass flow into the sections following them. The circumferential speeds of the other clamping points—assuming Hookean material—can not change the mass flow in a steady manner. The circumferential speeds will be called speeds in brief in the following text.

Register Control Loop I

The partial register error $Y_{13}^*$ measured before the clamping point 3 (K3)—for example a turner unit—by a sensor 6 is, as FIG. 2 shows, controlled to a set point $Y_{13w}^*$ by a register controller 3.2 by controlling the speed $v_3$ of this clamping point 3 (K3). Instead of measuring the part register error $Y_{13}^*$ immediately before the turner unit (K3), a measurement location between cooling unit (K2) and turner unit (K3), for example even immediately after the cooling unit (K2), may also be selected, for example for constructional reasons.

Subordinated to this register control loop is a rotational speed control loop 3.3 of the drive motor assigned to the clamping point 3 (K3). The very fast dynamic behavior of the current control loop subordinated to the rotational speed control loop is negligible. The set point for the angular velocity (or for the rotational speed) of the clamping point 3 (K3) is $\omega_{3w}$.

If the set point for the part register error measured at the turner unit (K3) is zero, that is to say $Y_{13w}^*=0$, and, thus on average, so is the actual value, then in spite of this measure, the total cutting register error $Y_{14}$ would generally not be zero, since, on the path between turner unit (K3) and knife cylinder (K4), the web is subjected on the further guide elements through which it must pass (for example former roll, former, slipping transport rolls in the folder, etc.) to forces which produce permanent cutting register errors in the event of a change in the web tensions, for example in the event of a reel change. Therefore, the total register error $Y_{14}$ is also measured and influenced, a plurality of variants occurring. These variants are preferably explained for single-web operation using the exemplary embodiments. For multi-web operation, reference is made to the parallel German Application No. DE 103 35 886.

Register Control Loop II a) Register Control Loop for the Cutting Register Error $Y_{14}$ (Variant 1)

Instead of the above-described register control I for the partial register error $Y_{13}^*$, a register control loop for the total cutting register error $Y_{14}$ may be provided directly. The manipulated variable is the lead or position of the knife cylinder 4. For this purpose, The cutting register error is measured shortly before the knife cylinder 4 using a sensor 5. the cutting register error supplied to the comparison point of a cutting register controller 4.1 and compared with a set point $Y_{14w}=0$ (dashed line in FIG. 2). The register controller 4.1 prescribes a position set point $\alpha_{14w}$. If a cutting register error occurs, for example in the event of a reel change, the cutting register error is compensated for in accordance with the dynamics of the subordinate angle control loop.

b) Control Loop for the Total Cutting Register Error $Y_{14}$ and Subordinate Control Loop for the Part Register Error $Y_{13}^*$ (Variant 2)

However, the control loop for the total cutting register error $Y_{14}$ may also be superimposed on the control loop for the part register error $Y_{13}^*$ in accordance with the principle of cascade control. For this purpose, the total register error, as described in a) and in the section "Register control loop I", is measured shortly before the knife cylinder with a further sensor 6, supplied to the comparison point of the cutting register control of 3.1 and compared with the set point $Y_{14w}=0$. The subordinate loop (register control 3.2) detects, as early as at the location of the turner unit (K3), that a subsequent cutting register error will occur. The cutting register controller 3.1 guides the set point $Y_{13w}^*$ such that, within the scope of the dynamic possibilities, $Y_{14w}=0$ is always maintained. With the aid of the speed $v_3$ of the turner unit (K3), the total cutting register error at the knife cylinder (K4) is therefore influenced suitably in this way. The cutting register controller 3.1 may, for example comprise a PI controller, which is optimized in accordance with the magnitude optimum or the symmetrical optimum (see Föllinger, O.: Regelungstechnik [Control engineering], Heidelberg: Hüthig-Verlag 1988). The output variable from the register controller 3.1 is limited by a limit 3.6. The adaptation of the control loop to the machine speed and also the compensation of dynamic elements of these register control systems are carried out in an adaptation element 3.4. This may also be implemented directly in the register controller 3.1. In this case, an adaptation element is understood to mean an adaptation of the parameters (for example gain factors) of the closed control loop to the machine speed. For this purpose, characteristics (characteristic curves and/or dynamic transfer elements) are stored in the adaptation element.

In an embodiment, the at least one control loop comprises a plurality of control loops superimposed on each other in a cascade structure, where upon starting up the control loops, an identification process is performed to determine all the data of the mechanical controlled rotary press system while it is at a standstill or in operation, with and without a paper web passing through, and the controllers are optimized in accordance with analytical optimization equations. Here, the optimization is carried out with computer assistance or in a fully automated manner. The optimization is performed with the aid of a simulation program, where the simulation may be carried out off line or on line in real time.

c) Control Loop for the Cutting Register Error $Y_{14}$ and Subordinated Control Loop for the Partial Cutting Register Error Before the Former Roll (Variant 3)

In the case of single-web operation, it is also possible for the control loop for the total cutting register error $Y_{14}$ to be superimposed on a control loop for the partial cutting register error before the former roll instead of before the turner unit (K3), in accordance with the principle of cascade control (not shown in FIG. 2). For this purpose, the partial cutting register error before the former roll is measured by a sensor. The manipulated variable is the lead of the former roll. The control loop is constructed as in b).

Another clamping point i (Ki), for example located before the clamping point 3 (K3), may also replace the former roll or the turner unit. Accordingly, the partial cutting register error $Y_{1i}^*$ is measured and controlled at or before this clamping point i (Ki). The register correction is made either by the speed (lead) $v_i$ of this clamping point or $Y_{1i}^*$ is supplied to another control loop (for example including for the purpose of feedforward control). It is also possible to measure the partial cutting register error or errors at a plurality of non-printing clamping points i and k (Ki; Kk) located before the knife cylinder (K4) and correct it or them with the aid of associated control loops via the speeds of $v_i$ and $v_k$. The two control loops may also be combined in a suitable manner. In particular, the two control loops may comprise at least one periodic controller which, in terms of its action, is matched to a periodic disturbance (see U.S. Pat. No. 5,988,063).

Angle Tracking

Since the register control via the lead of the clamping point 3 (K3) (or other suitable clamping points, as shown above) is associated with a change in the web tension $F_{23}$, it is not possible to rule out the situation in which large disturbances cause excessively small or excessively large web tensions $F_{23}$, which can cause a web break. The web tension $F_{23}$ must therefore be restricted. For this purpose, the speed $v_3$ is limited by predefining an upper and lower limit 3.5 on the output variable $\omega_{3w}$ of a register controller 3.2. When one of the upper and lower lead limits 3.5 is reached, the angular position of the printing units, that is to say the clamping point 1 (K1) in FIG. 1, is readjusted. The register controller 1.1 then performs the register correction (dash-dotted lines in FIG. 2). When the output variable is back within its permissible range, the register controller 3.2 assumes control from register controller 1.1 (override control).

To allow a manipulated variable to always be sufficiently available for the register correction via the speed (lead) of clamping point 3 (K3) with regard to the permissible range of the web tension $F_{23}$, a set point for the readjustment of the angle $\alpha_{1w}$ is always calculated in an adaptation element 1.2 with the aid of a mathematical model from the lead of clamping point 3 (K3). This mathematical model describes the relationship between the lead changes occurring for the correction of the part register error $Y_{13}^*$ and the resultant correction value $\alpha_{1w}$. While the register correction via the lead of clamping point 3 (K3) is carried out as fast as possible, the readjustment of the angle $\alpha_{1w}$ is a correction which is slow by contrast. As a result, fast movements of the printing units, which cost energy and may possibly cause ghosting, are avoided. For this purpose, the adaptation element 1.2 additionally contains a delay element of first or higher order. This additionally ensures that, in normal operation, that is to say during operation within the limits of the register controller 3.2, the register control loop and the angular readjustment of clamping point 1 (K1) are decoupled. The changeover between the control loops is carried out in an electronic switch 1.3, which is controlled by the evaluation of the limit 3.5. In normal operation, therefore, the angular readjustment by the adaptation element 1.2 always ensures that the change in the lead of the clamping point 3 (K3) that has occurred as a result of a disturbance being controlled out quickly is dissipated again slowly.

In addition, the superimposed controller 3.1 is provided with a limitation on the output variable. Since this superimposed control for $Y_{14}$ must in principle be adjusted more slowly than the subordinate one for $Y_{13}^*$, even in the case of large disturbances, it is hardly to be expected that an excessively large set point $Y_{13}^*$ will be predefined. Nevertheless, for example in the case of erroneous failure of the adaptation element 3.4 or of the sensor for $Y_{14}$, there could be too large a swing of the controller 3.1, for which reason a limitation is necessary.

Input Force Tracking

Since the register control via the lead of the clamping point 3 (or other suitable clamping points, as shown above) is associated with a change in the web tension $F_{23}$, as described above, it is not possible to rule out the situation in which large disturbances cause excessively small or excessively large web tensions $F_{23}$, which can lead to a web break.

Figure 3:
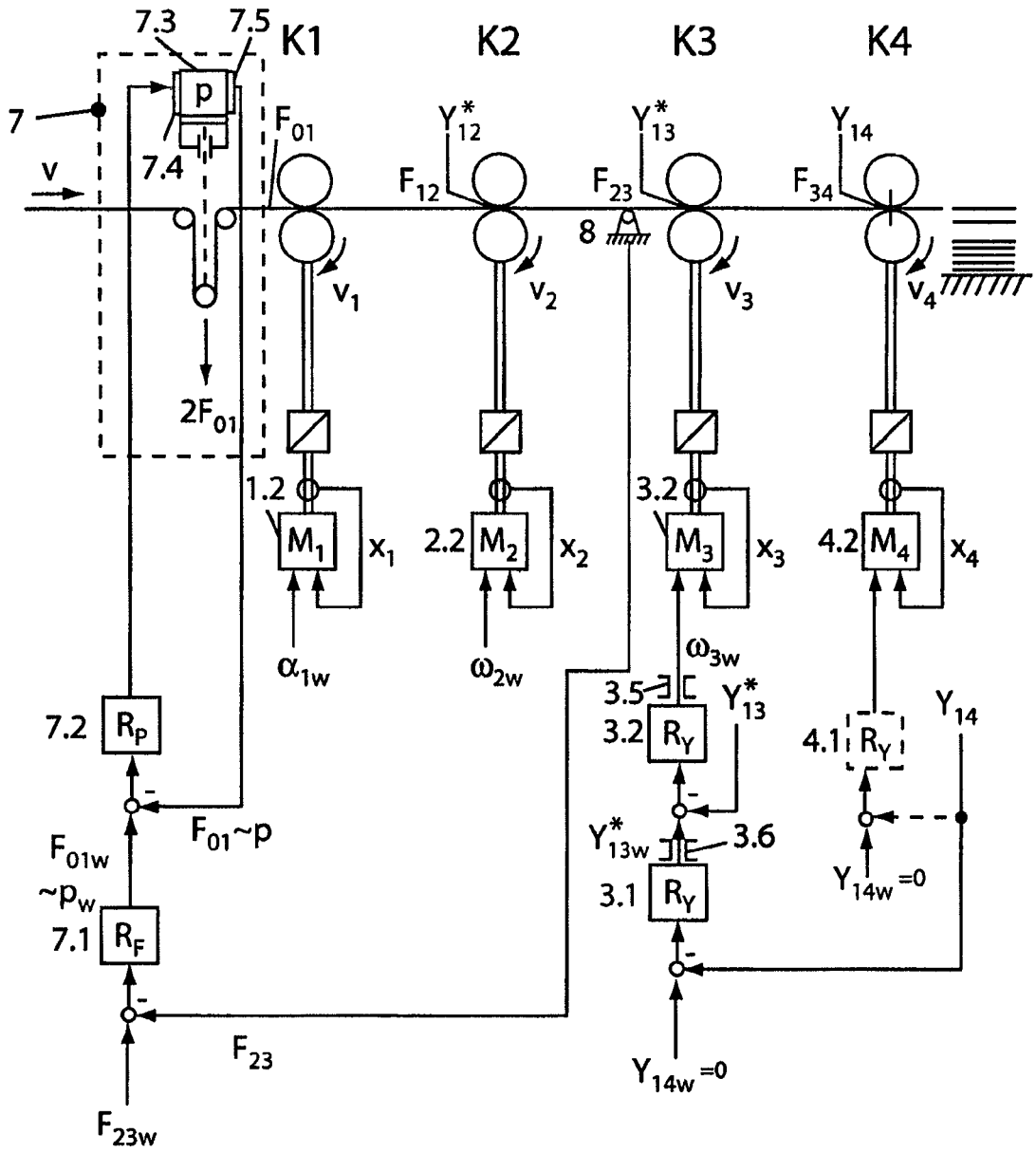
FIG. 3 is a schematic diagram of a control arrangement for tracking the dancer roll.

The force 2 $F_{01}$ of the dancer roll or of the dancer roll system 7 (see FIG. 3) is therefore readjusted such as, for example, via the pressure in the associated actuating device, i.e., the pneumatic cylinder 7.3. For this purpose, a force controller 7.1 has to be provided for the force $F_{23}$, to which the actual value of the force $F_{23}$—determined by a sensor 8—is supplied and is compared with the force set point $F_{23w}$. Its output variable is either directly the manipulated variable for the actuating device 7.3, equipped as a pneumatic cylinder, or the set point $F_{01w}$, if there is a subordinate control loop (controller 7.2) for the input web tension $F_{01}$. By means of this force adaptation, it is always ensured that the change in the force in section 2-3 that occurs quickly as a result of a disturbance being controlled out is dissipated more or less slowly by contrast. For this purpose (as in FIG. 2, block 1.2), an adaptation element can be provided. For the above-described data interchange, the dancer roll system 7 is equipped with communication interfaces 7.4, 7.5. Instead of the dancer roll system 7, a self-aligning roll system may alternatively be used.

The dancer or self-aligning roll system can also be replaced by a web tension control loop, which predefines the force $F_{01}$ (see FIG. 1). Both actions change the steady and unsteady mass flow introduced into the system by the circumferential speed of an unwind device. This circumferential speed can also be influenced by at least one measured value for a web tension, web stress or web extension.

The angle tracking of the printing units (K1) described can also be replaced by tracking of the lead of the cooling unit (K2), as will be described below.

Tracking the Lead of the Cooling Unit

Figure 4:
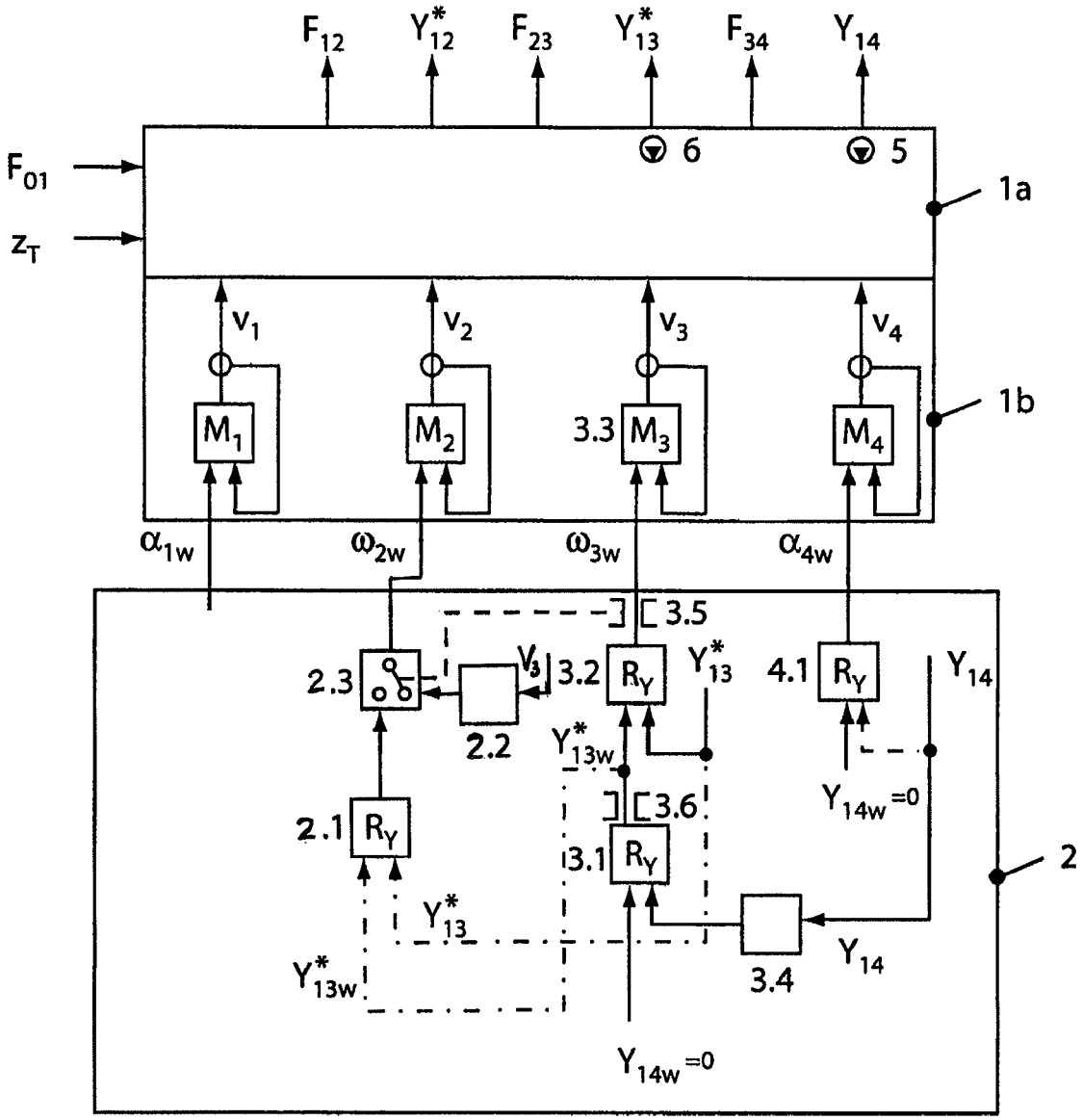
FIG. 4 is a schematic diagram of a control arrangement for controlling the cutting register with force limitation via the cooling unit.

Since the register control via the lead of the clamping point 3 (K3) (or other suitable clamping points, as shown above) is associated with a change in the web tension $F_{23}$, it is not possible to rule out the situation in which large disturbances cause excessively small or excessively large web tensions $F_{23}$, which can lead to a web break. The web tension $F_{23}$ must therefore be restricted. For this purpose, the speed $v_3$ is limited by predefining an upper and lower limit 3.5 on the output variable $\omega_{3w}$ of a register controller 3.2. When one of these lead limits is reached, the lead of the cooling unit, that is to say the clamping point 2 (K2) in FIG. 1, is readjusted. A register controller 2.1 then performs the register correction (dash-dotted lines in FIG. 4). When the output variable of register controller 3.2 is back in a permissible range, the register control at 3.2 resumes control from register controller 2.1 (override control).

The use of the lead of the cooling unit (K2) for limiting the force $F_{23}$ is made possible by the fact that when the speed $v_2$ is adjusted, the force $F_{23}$ is not self-compensating. This can be attributed to the change in the paper properties as a result of the input of moisture and heat by the printing units and the drying section.

In order that a manipulated variable is always sufficiently available for the cutting register error correction via the speed (lead) of clamping point 3 (K3) with regard to the permissible range of the web tension $F_{23}$, a set point for the readjustment of the angular velocity $\omega_{2w}$ is always calculated in an adaptation element 2.2 with the aid of a mathematical model from the lead of clamping point 3 (K3). This mathematical model describes the relationship between the lead changes occurring for the correction of the part register error $Y_{13}^*$ and the resultant correction value $\omega_{2w}$. While the cutting register error correction via the lead of clamping point 3 (K3) is carried out as fast as possible, the readjustment of the angular velocity $\omega_{2w}$ is a correction which is slow by contrast. For this purpose, the adaptation element 2.2 additionally contains a delay element of first or higher order. This additionally ensures that, in normal operation, that is to say during operation within the limits of the register controller 3.2, the register control loop and the angular readjustment of clamping point 2 (K2) are decoupled. The changeover between the control loops is carried out in an electronic switch 2.3, which is controlled by the evaluation of the limit 3.5. In normal operation, therefore, the angular readjustment by means of the adaptation element 2.2 always ensures that the change in the lead of the clamping point 3 (K3) that has occurred as a result of a disturbance being controlled out quickly is dissipated again slowly.

The above-described measures for cutting register control are not intended to relate just to the application in web-fed offset rotary presses but can be applied in all other printing processes, printing materials and presses in an equivalent way, in particular in gravure printing, screen printing, flexographic printing, textile printing, film printing, metal printing, label printing machines, textile printing machines, film printing machines, illustration and newspaper presses.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A method for controlling a position of a cutting register on a printed web in a rotary press, comprising the steps of:

registering, by a sensor, a cutting register comprising one of a specific item of image information and a measuring mark on a printed web running-through the rotary press, the sensor being arranged at a knife cylinder of the rotary press;

supplying a register signal from the sensor to a control device, the register signal being generated by the sensor in response to the cutting register;

determining, by the control device, a partial cutting register error from the register signal, the partial cutting register error representing a deviation of the cutting register from its intended position at the time of said step of registering; and influencing the speed of at least one clamping point located upstream of the knife cylinder in the rotary press in response to the partial cutting register error for correcting the partial cutting register error, the at least one clamping point being arranged in a cooling unit;

wherein the step of influencing comprises controlling an angular velocity of at least one clamping unit with a first controller, the at least one clamping unit being an existing non-printing draw unit or clamping point arranged in an area of the web course downstream of the last printing unit to the knife cylinder, and during said step of influencing, tracking a web tension of a section of the web between two clamping points in the rotary press and changing one of an input web tension force or the set point for a subordinate controller for the input web tension to restrict the web tension by limiting a speed of the web to a predefined upper and lower limit, so that a force adaptation is effected for dissipating a force change in the section between the two clamping points or a force change in sections between further clamping points which occur as a result of controlling the cutting register error in the rotary press, and during said step of influencing controlling, by a first controller a manipulated variable for correcting the partial cutting register error;

wherein the method further comprises:

transferring control of the angular velocity of the cooling unit from the first controller to a second controller for tracking a clamping point upstream of the cooling unit and moving the manipulated variable back into a permissible range if the limits of the manipulated variable are exceeded during control of the part register error.

2. The method of claim 1, wherein said step of influencing comprises:

correcting the partial cutting register error to a specific set point by at least one control loop having a first controller for controlling an angular velocity of the at least one clamping point; and supplying, by a second controller, the set point for the partial cutting register error based on a set point for the total register error.

3. The method of claim 2, wherein the at least one control loop comprises a plurality of control loops superimposed on each other in a cascade structure, the method further comprising starting up the control loops step by step, performing an identification process for determining all the data of the mechanical controlled rotary press system at a standstill or in operation, with and without a paper web passing through, and optimizing the controllers, the optimization being carried out with computer assistance or fully automatically.

4. The method of claim 3, wherein the step of optimizing is performed with the aid of a simulation program.

5. The method of claim 1, wherein the step of influencing comprises influencing the speeds of at least two non-printing clamping points of the rotary press, control loops for controlling that at least two clamping points being one of superimposed on and subordinated to each other for correcting the total cutting register error to the set point for the total cutting register error.

6. The method of claim 5, wherein said step of influencing comprises:

manipulating, by the control loops, a plurality of manipulated variables for controlling partial cutting register errors at each of the at least two non-printing clamping points;

determining when the limits of at least one of the plurality of manipulated variables are exceeded during control of the partial cutting register errors;

transferring the control of the manipulated variables to a further controller for tracking the angle of a first clamping point upstream of the at least two non-printing clamping points and moving the value of the at least one of the plurality of manipulated variables back into a permissible ranges.

7. The method of claim 6, wherein the tracking of the angle of the first clamping point by an adaptation element for all operating states in which the manipulated variables lie within the prescribed limits is carried out slowly compared with the control of the partial cutting register errors, whereby ghosting arising from excessively fast position changes of the first clamping point is avoided and decoupling of the control loops is achieved.

8. The method of claim 5, further comprising tracking of a second clamping point downstream of the first clamping point with angular synchronism with respect to the first clamping point such that web time constants between the first and second clamping points are ineffective.

9. The method of claim 5, wherein one of the two non-printing clamping points is arranged in a cooling unit and the step of influencing comprises controlling, by controllers, a plurality of manipulated variables for correcting the part register errors, said method comprising:

transferring control of the lead of the cooling unit from an associated controller to a second controller for tracking a clamping point upstream of the cooling unit and moving the manipulated variables back into permissible ranges if the limits of the plurality of manipulated variables are exceeded during control of the part register errors.

10. The method of claim 1, wherein said step of influencing comprises:

manipulating, by a first controller, a variable related to said at least one clamping point for controlling the partial cutting register error;

determining when a limit of the manipulated variable is exceeded during the controlling of the part register error; and transferring control of the manipulated variable of the printing units from the first controller to a further controller for tracking the angle of a first clamping point upstream of the at least one clamping point and moving the value of the manipulated variable back into a permissible range.

11. The method of claim 10, wherein the manipulated variable is the circumferential speed of an unwind device that determines the steady and unsteady mass flow introduced into the rotary press.

12. The method of claim 11, wherein the circumferential speed is influenced by at least one measured value for a web tension, web stress or web extension, the position of a dancer or self-aligning roll that acts on the web with the force, or a web tension control loop that controls the force.

13. The method of claim 11, further comprising tracking of clamping points after the cooling unit which controls the partial cutting register performed synchronously with the tracked clamping point such that the web time constants between the tracked clamping point and clamping points downstream therefrom are ineffective.

14. The method of claim 1, further comprising the step of:

tracking, by an adaptation element, the angle of a first clamping point during all operating states in which the angular velocity of each of the clamping points of the rotary press lies within an associated limit; and calculating a set point for the readjustment of the angle with the aid of a mathematical model, as a result of which a sufficient reserve of the manipulated variables of the each of the clamping points is always ensured.

15. The method of claim 14, further comprising calculating, in the mathematical model, the relationship between the lead changes needed for the corrections of the determined part register errors and the resultant correction value.

16. The method of claim 14, wherein the tracking of the angle of the first clamping point by the adaptation element for all operating states in which the manipulated variables lie within the prescribed limits is carried out slowly compared with the control of the partial cutting register errors, whereby ghosting arising from excessively fast position changes of the first clamping point is avoided and decoupling of the control loops is achieved.

17. The method of claim 1, further comprising the steps of tracking the lead of a tracked clamping point by an adaptation element for all operating states in which the angular velocity of the clamping points of the rotary press lie within respective limits, calculating a set point for the readjustment of the speed of the tracked clamping point using a mathematical model, so that a sufficient reserve of the manipulated variables of the clamping points is always ensured.

18. The method of claim 17, further comprising calculating, in the mathematical model, the relationship between the lead changes needed for the corrections of the part register errors and the resultant correction value.

19. The method of claim 17, wherein the step of tracking the lead of the tracked clamping point by the adaptation element is carried out slowly relative to the control of the partial cutting register errors so that decoupling of the control loops is achieved.

20. The method of claim 1, wherein the step of tracking comprises tracking the web tension of the section of the web between two clamping points in the rotary press with the aid of one of a dancer roll and self-aligning roll by supplying a measured force to a web tension controller as an actual value and comparing the actual value with a force set point, and outputting an output variable from the web tension controller, the output variable being either directly the manipulated variable for an actuating device that changes the input web tension force or the set point for a subordinate controller for the input web tension, so that a force adaptation is effected for dissipating a force change in the section between the two clamping points or a force change in the sections between further clamping points which occur as a result of a disturbance being controlled out.

21. The method of claim 1, wherein the step of tracking comprises tracking the web tension of the section of the web using a web tension control loop, measuring the web tension by a sensor, wherein the output variable from a web tension controller is proportional to the circumferential speed of at least one clamping point located before it which influences the mass flow through the rotary press.

22. A method for controlling a position of a cutting register on a printed web in a rotary press, comprising the steps of:

registering, by a sensor, a cutting register comprising one of a specific item of image information and a measuring mark on a printed web running-through the rotary press, the sensor being arranged at a knife cylinder of the rotary press;

supplying a register signal from the sensor to a control device, the register signal being generated by the sensor in response to the cutting register;

determining, by the control device, a partial cutting register error from the register signal, the partial cutting register error representing a deviation of the cutting register from its intended position at the time of said step of registering; and influencing the speed of at least one clamping point located upstream of the knife cylinder in the rotary press in response to the partial cutting register error for correcting the partial cutting register error;

wherein the step of influencing comprises controlling an angular velocity of at least one clamping unit with a first controller, the at least one clamping unit being an existing non-printing draw unit or clamping point arranged in an area of the web course downstream of the last printing unit to the knife cylinder, during said step of influencing, tracking a web tension of a section of the web between two clamping points in the rotary press and changing one of an input web tension force or the set point for a subordinate controller for the input web tension to restrict the web tension by limiting a speed of the web to a predefined upper and lower limit, so that a force adaptation is effected for dissipating a force change in the section between the two clamping points or a force change in sections between further clamping points which occur as a result of controlling the cutting register error in the rotary press, one of two non-printing clamping points being arranged in a cooling unit, and during said step of influencing, influencing the speeds of at least two non-printing clamping points of the rotary press, control loops for controlling that at least two clamping points being one of superimposed on and subordinated to each other for correcting the total cutting register error to the set point for the total cutting register error, and during said step of influencing, controlling, by controllers, a plurality of manipulated variables for correcting the part register errors, wherein the method further comprises:

transferring control of the lead of the cooling unit from an associated controller to a second controller for tracking a clamping point upstream of the cooling unit and moving the manipulated variables back into permissible ranges if the limits of the plurality of manipulated variables are exceeded during control of the part register errors.

* * * * *